US005593307A

United States Patent [19]

Bale et al.

[11] Patent Number: 5,593,307

[45] Date of Patent: Jan. 14, 1997

[54] CONNECTOR INCLUDING AN INSULATIVE BRIDGE

[75] Inventors: Alain Bale, Chauffour Notre Dame; Patrick Champion, Change, both of France

[73] Assignee: Framatome Connectors International, Paris, France

[21] Appl. No.: 325,656

[22] Filed: Oct. 18, 1994

[30] Foreign Application Priority Data

Oct. 19, 1993 [FR] France ..... 93 12445

[51] Int. Cl.[6] ..... H01R 23/70

[52] U.S. Cl. ..... 439/79; 439/567

[58] Field of Search ..... 439/79, 80, 567

[56] References Cited

U.S. PATENT DOCUMENTS

| | | | |
|---|---|---|---|
| 4,491,376 | 1/1985 | Gladd et al. | 439/79 |
| 4,612,602 | 9/1986 | Weyer et al. | 439/65 |
| 5,133,679 | 7/1992 | Fusselman et al. | 439/79 |
| 5,184,963 | 2/1993 | Ishikawa | 439/79 |

FOREIGN PATENT DOCUMENTS

| | | | |
|---|---|---|---|
| 337634 | 10/1989 | European Pat. Off. . | |
| 549461 | 6/1993 | European Pat. Off. . | |
| 3925958 | 2/1991 | Germany | 439/79 |
| WO87/00978 | 2/1987 | WIPO . | |

*Primary Examiner*—Neil Abrams
*Attorney, Agent, or Firm*—Pollock, Vande Sande & Priddy

[57] ABSTRACT

A connector includes an insulative bridge having a U-shape cross-section, i.e., a central region and two lateral branches, and elbow electrical contact members. The contact members have front contact regions housed in openings of the central region of the bridge and elbow regions and rear contact regions. The connector also includes a retaining peg for fixing it to a flat support and a rear insulative body surrounding the electrical contact members in at least one area between the front contact region and the elbow region. The retaining peg is fastened to one side of the rear insulative body.

9 Claims, 2 Drawing Sheets

CONNECTOR INCLUDING AN INSULATIVE BRIDGE

BACKGROUND OF THE INVENTION

1. Field of the Invention

The present invention concerns a connector including an insulative bridge having a U-shape cross-section, i.e., a central region and two lateral branches, elbow electrical contact members having front contact regions housed in openings in the central region of the bridge, elbow regions and rear contact regions, and a retaining peg, for example a peg of the type that can be deformed by heat to fix the connector to a flat support.

2. Description of the Prior Art

A connector of the aforementioned type is marketed by Dupont under the trademark "METRAL". It includes a bridge having a relatively massive central region which carries a peg that can be deformed by heat. Mechanical stiffness is achieved by virtue of the fact that an edge of the central region of the bridge and the lower edge of one of the branches near the latter bear against an edge of the printed circuit. This allows a nominal spacing of 14 mm between the lower edge of the branch and the last of four rows of contacts.

This design has the drawback that this branch of the bridge is not well protected during wave soldering, since that it comes into contact with the edge of the printed circuit.

An object of the present invention is a connector which does not have the aforementioned drawback.

SUMMARY OF THE INVENTION

The invention consists in a connector including an insulative bridge having a U-shape cross-section, i.e., a central region and two lateral branches, and elbow electrical contact members having front contact regions housed in openings of the central region of the bridge and elbow and rear contact regions, a retaining peg for fixing the connector to a flat support, and a rear insulative body surrounding the electrical contact members in at least an area between the front contact region and the elbow region, said retaining peg being fastened to one edge of the rear insulative body.

The rear insulative body stiffens the electrical contact members and, since the retaining peg, which can be deformable by heat or a force-fit ("press-fit") peg, for example, is no longer carried by the bridge, but rather by the rear insulative body, the bridge can be disposed differently relative to the printed circuit. Also, standard bridges can be used.

In a preferred embodiment of the invention, the edge of the rear insulative body is substantially aligned with an outer edge of a branch of the bridge. A connector can then be implemented by mounting the bridge so that the outer edge of the branch bears on an upper surface of a flat support such as a printed circuit board. As a result, the assembly is rigid, the bridge is on the side opposite that exposed to the effects of wave soldering, and the previously mentioned nominal spacing can be reduced, for example to approximately 10 mm.

In a second embodiment of the invention, the edge of the rear insulative body is set back relative to an outside edge of a branch of the bridge. A connector can then be implemented with the bridge spaced from an outer edge of the flat support. This prevents wetting of the bridge by a wave, soldering wave since the bridge is entirely outside the perimeter of the printed circuit. In this case, the nominal spacing of 14 mm can be retained.

The invention will be better understood from the following description, given by way of example with reference to the drawings.

DETAILED DESCRIPTION OF THE PREFERRED EMBODIMENTS

Figure 1:
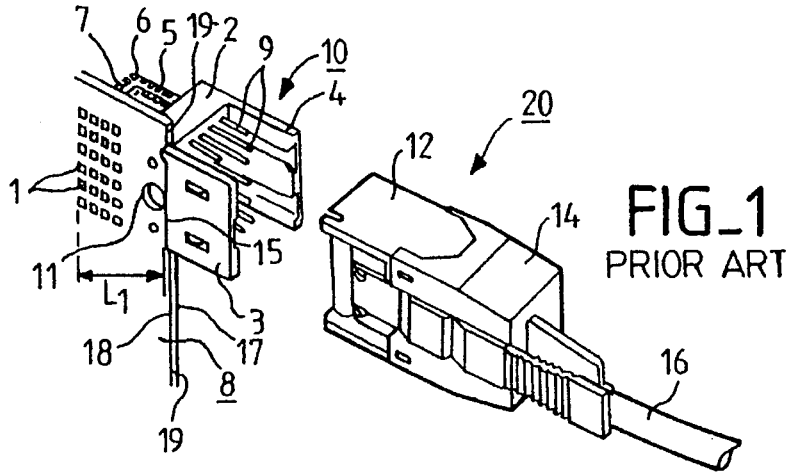
FIG 1 PRIOR ART
FIG. 1 shows a METRAL prior art connector.

As shown in FIG. 1, a connector marketed under the trademark METRAL has a rear part with elbow contact members. Each contact member has a termination 1 soldered to the lower side 18 of a printed circuit board 8, a straight region connecting the termination 1 to an elbow region 6 and another straight region 5 extending from the elbow region 6 through a central region 2 of a "U" shape bridge 10, the straight region 9 being extended towards the front by male terminations 9 disposed between the two lateral branches 3 and 4 of the bridge 10. One lateral side of the central region adjoining the branch 3 bears against an upper side 17 of the printed circuit 8 and this side carries a peg 11 which can be deformed by heat and by means of which it is mechanically fastened to the lower surface 18 of the printed circuit 8 near its edge 19. The rear side 15 of the lateral branch 3 bears against the edge 19 of the printed circuit 8 and absorbs rotation forces applied to the bridge 10.

A connector 20 has a female front part 12, a cable support 14 and a cable 16.

The distance L1 between the side 15 of the branch 3 and the rear edge of the rearmost row of contact members is 14 mm. This distance is determined by various factors: the central region 2 must be sufficiently thick to provide the mechanical stiffness of the assembly and the peg 11 must be sufficiently far from the edge 15 of the branch 3 to enable the insertion of a tool for deforming the peg 11 by application of heat. In this latter regard, note that the plane external surface of the branch 3 projects beyond the lower surface 18 of the printed circuit 8.

Figure 2:
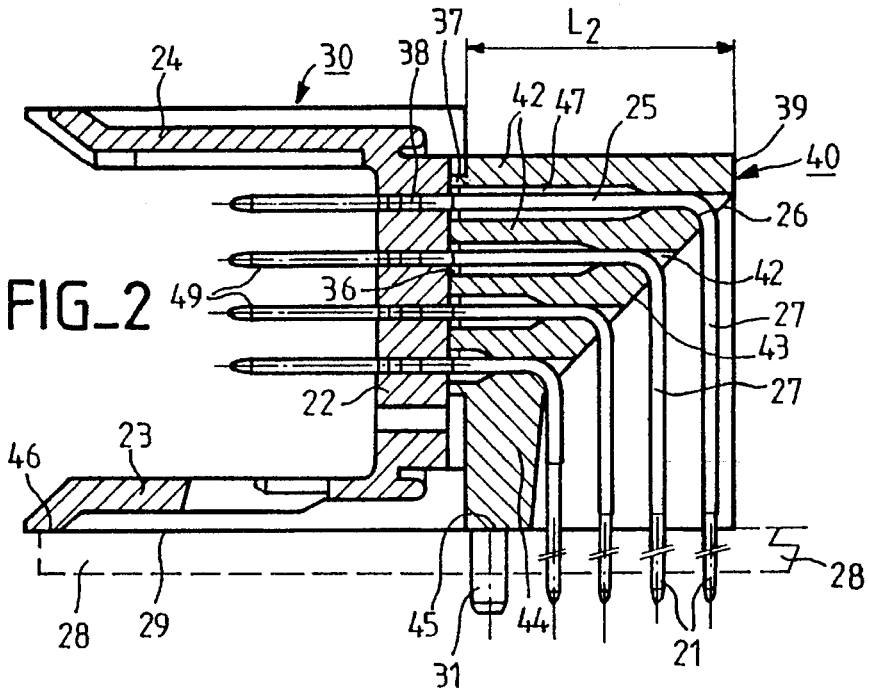
FIG. 2 shows a first embodiment of the invention.

As shown in FIG. 2, a connector according to the invention has at the rear an insulative body 40 having longitudinal openings 47 extended rearwards via a constriction area 42 and opening onto a surface 43 which in this example is inclined at substantially 45°. The contact members have a front terminal 49 constituted by a male terminal housed between the lateral branches 23 and 24 of a "U" shape bridge 30 whose central part 22 has through-openings 38 into which are force-fitted terminals 49 extended to the rear by a straight region 25 disposed in an opening 47 and to the rear of the constriction area 42 which holds it by an elbow region 26 and then another straight region 27 which ends at a contact (or terminal) region 21 which is a force-fit ("press-fit") in holes in a printed circuit 28. The insulative body 41 has an extension 44 with one side 45 bearing on the upper surface 29 of the printed circuit 28 and carrying a peg 31 which can be deformed by heat to fasten the block 41 mechanically to the printed circuit 28. The lateral branch 23 can have a surface 46 (an end surface as shown here, for example) which bears against the upper surface 29 of the printed circuit 28. The insulative block 40 contributes to the mechanical stiffness of the part of the connector to the rear of the bridge 30. As a result, a standard bridge 30 can be used. Also, as the bridge 30 is mounted on the upper surface 29 of the printed circuit 28, it is entirely protected during wave soldering. Finally, there is no longer any need for a tool insertion space as large as is required in the prior art. The distance L2 between the base of the bridge 30 and the rear surface 39 of the insulative body 40 can be in the order of 10 mm rather than 14 mm.

Because it is disposed on the insulative body 40 which holds the members (25, 26, 27, 21), the peg 31 contributes to guiding of the terminals 21 when the latter are force-fitted into the holes in a printed circuit 28.

Also, the connection between the bridge 30 and the rear insulative body 40 is strengthened by the fact that the force-fitted terminations 38 of the terminals 49 contribute to the nesting effect between extensions 37 of the insulation body 40 and extensions 36 of the bridge 30.

Figure 3:
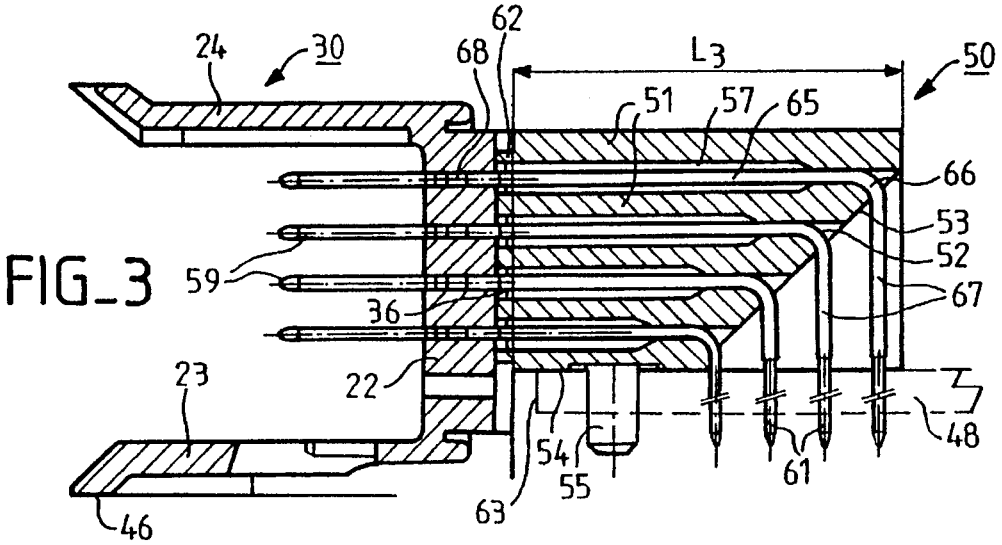
FIG. 3 shows a second embodiment of the invention.

The FIG. 3 embodiment uses a bridge 30 which can be identical to that of FIG. 2. The connector has a rear insulative body 50 without an extension like the extension 44. The rear insulative body 50 carries on its surface 54 a peg 55 which can be deformed by heat to fasten it to a printed circuit 48. The contact members have male terminals 59 housed between the lateral branches 23 and 24, force-fitted at 68 and extended towards the rear by straight regions 65 longer than the regions 25 in FIG. 2, then elbow regions 66 and finally by further straight regions 67 which are shorter than the regions 27 in FIG. 2. The bridge 30 and the rear insulation 50 can be nested at 36 for the bridge 30 and at 62 for the rear insulative body 50.

With a distance L3 greater than L2, for example L3=14 mm, the bridge 30 is spaced from the edge 63 of the printed circuit 48. It is therefore possible to carry out a wave soldering operation with no risk of wetting the lateral branch 23 of the bridge 30. Remember that during this operation the solder wave must be able to lap the lateral edges of the printed circuit 48.

Another advantage of the FIG. 2 and 3 embodiments is that the respective rear insulative body 40 and 50 supports the respective terminals 21 and 61 when they are inserted into the holes in the respective printed circuit 28 and 48.

In an alternative embodiment, the male terminals 49 and 59 are replaced by female terminals.

Figure 4:
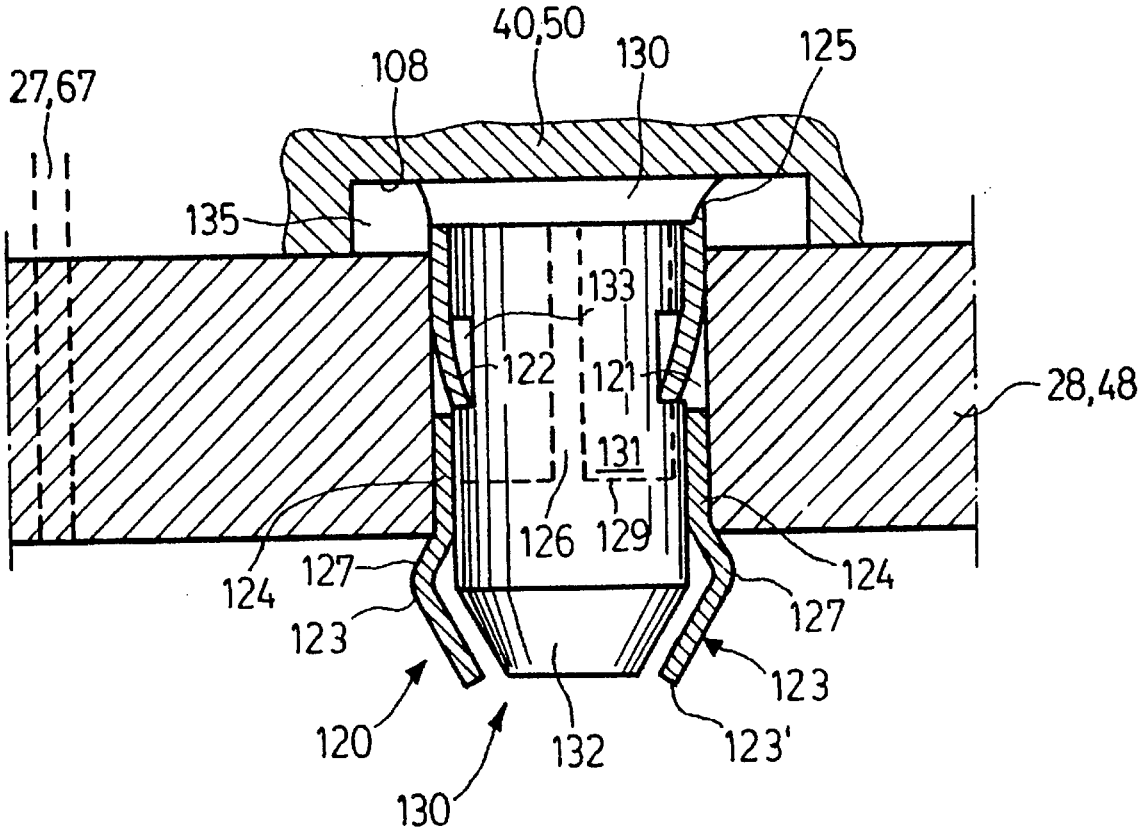
FIG. 4 shows one variant of the retaining peg, of the force-fit type.

As shown in FIG. 4, the insulative body 40 or 50 has a cylindrical peg 130 including a cylindrical region 131, at least one housing 133 and a frustoconical end 132. The cylindrical peg 130 is fastened to the insulative body 40 or 50 and is manufactured in a similar way to a peg that can be deformed by heat. A metal part 120 has a hollow cylindrical body 124 including a notch 126 and at least one spring arm 122 adapted to snap into the housing 133. The part 120 has a bottom end 125 abutting the base of the peg 130 and an upper end 129 extended by spring arms 123; in this example there are three arms at 120°, but there could be four arms at 90°, for example. The elastic arm 123 has a proximal region 127 extending outwards and a distal region 123' at right angles to the region 127, the distal region 123' being directed inwards. The proximal region 127 provides a snap-fastener abutment to hold the printed circuit 28 or 48 abutted against an upper side of the insulative body 40 or 50. To attach a printed circuit to an insulative body having one or more cylindrical pegs 130, the cylindrical body 124 is first inserted until the tongues 122 snap into the housings 133. Then the opening (or the openings) 121 of the printed circuit 40 or 50 is (or are) offered up to the distal end 123' of the spring arms 123. The spring arms 123 are pushed in, enabling insertion of the printed circuit 40 or 50 until it abuts against the surface of the insulative body 40 or 50 in a position in which the proximal end 127 is snap-fastened by resilient outward deployment of the arms 123. The diameter of the peg 130 can be in the order of 1 mm.

The metal part 120 can be demounted by pivoting it around the axis of the hollow cylinder 124 in order to disengage the elastic arm(s) 122 from the housing(s) 133.

There is claimed:

1. Connector including an insulative bridge having a U-shape cross-section, said bridge comprising a central region and two lateral branches, and elbow electrical contact members having front contact regions force-fitted in through openings of the central region of the bridge, and extended rearwardly by straight regions, a rear insulative body assembled to said bridge, elbow regions joining said straight regions and holding together said U-shaped bridge and said rear insulative body, and rear contact regions, a retaining peg for fixing the connector to a flat support, said rear insulative body surrounding said electrical contact members in at least one area between said front contact region and said elbow region, said retaining peg being fastened to one side of said rear insulative body.

2. Connector according to claim 1, wherein said retaining peg can be deformed by heat.

3. Connector according to claim 1, wherein said retaining peg is of a force-fit type.

4. Connector according to claim 1, wherein said edge of said rear insulative body is substantially aligned with an outside edge of a branch of said bridge.

5. Connector according to claim 4, wherein said rear insulative body includes an extension including said edge.

6. Connector according to claim 1, wherein said edge of said rear insulative body is set back relative to an outside edge of a branch of said bridge.

7. Connector according to claim 1, wherein said bridge and said rear insulative body are assembled together by nesting.

8. Connector according to claim 1, wherein said retaining peg is fastened to one side of said rear insulative body substantially aligned with an outer side of a branch of said bridge, and said outer side of said branch of said bridge bears against said flat support.

9. Connector according to claim 1, wherein said side of said rear insulative body is set back relative to an outer side of a branch of said bridge, and said bridge is spaced from a side of said flat support.

* * * * *